US007140452B2

(12) United States Patent
Hutchinson

(10) Patent No.: US 7,140,452 B2
(45) Date of Patent: Nov. 28, 2006

(54) METHOD AND APPARATUS FOR DETERMINING DRILL STRING MOVEMENT MODE

(76) Inventor: Mark W. Hutchinson, Willowbank House, 34 Station Road, Marlow, Bucks SL7 1NX (GB)

( * ) Notice: Subject to any disclaimer, the term of this patent is extended or adjusted under 35 U.S.C. 154(b) by 0 days.

(21) Appl. No.: 11/253,154

(22) Filed: Oct. 18, 2005

(65) Prior Publication Data

US 2006/0065440 A1 Mar. 30, 2006

Related U.S. Application Data

(60) Division of application No. 10/957,400, filed on Oct. 1, 2004, now Pat. No. 7,114,578, which is a continuation of application No. PCT/US03/10277, filed on Apr. 3, 2003.

(60) Provisional application No. 60/374,117, filed on Apr. 19, 2002.

(51) Int. Cl.
*E21B 47/09* (2006.01)

(52) U.S. Cl. ..... 175/39; 175/45; 166/66; 166/250.01

(58) Field of Classification Search ..... None
See application file for complete search history.

(56) References Cited

U.S. PATENT DOCUMENTS 5,205,163 A * 4/1993 Sananikone ..... 73/152.48
5,402,677 A * 4/1995 Paslay et al. ..... 73/152.43

* cited by examiner

*Primary Examiner*—Zakiya W. Bates
(74) *Attorney, Agent, or Firm*—Richard A. Fagin

(57) ABSTRACT

A method for determining movement mode in a drill string includes measuring lateral acceleration of the drill string, determining lateral position of the drill string from the acceleration measurements, and determining mode from the position with respect to time. Also disclosed is a method including measuring drill string acceleration along at least one direction, spectrally analyzing the acceleration, and determining existence of a particular mode from the spectral analysis. Also disclosed is a method for determining destructive torque on a BHA including measuring angular acceleration at at least one location along the BHA, and comparing the acceleration to a selected threshold. The threshold relates to a moment of inertia of components of the BHA and a maximum torque applicable to threaded connections between BHA components. A warning is generated when acceleration exceeds the threshold.

17 Claims, 11 Drawing Sheets

| BHA SEGMENT | | WHIRL FREQ | AXIAL FREQ | TORSIONAL FREQ | LATERAL FREQ |
|---|---|---|---|---|---|
| HWDP(34) | C1 | W1 | A1 | T1 | L1 |
| STAB 1(38A) | C2 | W2 | A2 | T2 | L2 |
| DRILL COLL(36) | C3 | W3 | A3 | T3 | L3 |
| STAB 2 (38) | C4 | W4 | A4 | T4 | L4 |
| BIT (40) | C5 | W5 | A5 | T5 | L5 |
| ENTIRE BHA (42A) | C6 | W6 | A6 | T6 | L6 |

| | |
|---|---|
| $m$ | = MASS |
| $R$ | = BOREHOLE RADIUS |
| $r$ | = DRILL STRING COMPONENT RADIUS |
| $\omega$ | = WHIRL VELOCITY |
| $\mu$ | = FRICTION FACTOR |
| $\tau_{wsf}$ | = RESULTANT FRICTIONAL TORQUE PER UNIT LENGTH FROM WHIRL SIDE FORCE |

METHOD AND APPARATUS FOR DETERMINING DRILL STRING MOVEMENT MODE

CROSS-REFERENCE TO RELATED APPLICATIONS

This is a division of U.S. patent application Ser. No. 10/957,400 filed on Oct. 1, 2004, now U.S. Pat. No. 7,114,578, which application is a continuation of International Patent Application No. PCT/US03/10277 filed on Apr. 3, 2003. Priority is claimed from U. S. Provisional Application No. 60/374,117 filed on Apr. 19, 2002.

STATEMENT REGARDING FEDERALLY SPONSORED RESEARCH OR DEVELOPMENT

Not applicable.

BACKGROUND FO THE INVENTION

1. Field of the Invention

The invention relates generally to the field of drilling welibores through the earth. More particularly, the invention relates to apparatus and methods for determining the dynamic mode of motion of a drill string used to turn a drill bit.

2. Background Art

Drilling weilbores through the earth includes "rotary" drilling, in which a drilling rig or similar lifting device suspends a drill string which turns a drill bit located at one end of the drill string. Equipment on the rig and/or an hydraulically operated motor disposed in the drill string rotate the bit. The rig includes lifting equipment which suspends the drill string so as to place a selected axial force (weight on bit—"WOB") on the drill bit as the bit is rotated. The combined axial force and bit rotation causes the bit to gouge, scrape and/or crush the rocks, thereby drilling a weilbore through the rocks. Typically a drilling rig includes liquid pumps for forcing a fluid called "drilling mud" through the interior of the drill string. The drilling mud is ultimately discharged through nozzles or water courses in the bit. The mud lifts drill cuttings from the wellbore and carries them to the earth's surface for disposition. Other types of drilling rigs may use compressed air as the fluid for lifting cuttings.

The forces acting on a typical drill string during drilling are very large. The amount of torque necessary to rotate the drill bit may range to several thousand foot pounds. The axial force may range into several tens of thousands of pounds. The length of the drill string, moreover, may be twenty thousand feet or more. Because the typical drill string is composed of threaded pipe segments having diameter on the order of only a few inches, the combination of length of the drill string and the magnitude of the axial and torsional forces acting on the drill string can cause certain movement modes of the drill string within the wellbore which can be quite destructive. For example, a well known form of destructive drill string movement is known as "whirl", in which the bit and/or the drill string rotate precessionally about an axis displaced from the center of the wellbore, either in the same direction or in a direction opposite to the rotation of the drill string and drill bit. Another destructive mode is called "bit bounce" in which the entire drill string vibrates axially (up and down). "Lateral" vibrations and "torque shocks" can also be detrimental to drill string wear and drilling performance. Still other movement modes include "wind up" and torsional release of the bottom of the drill string when the bit or other drill string components momentarily stop rotation and then release. Any or all of these destructive modes of motion, if allowed to continue during drilling, both decrease drilling performance and increase the risk that some component of the drill string will fail.

The foregoing examples are not intended to be an exhaustive representation of the destructive movement modes a drill string may undergo, but are only provided as examples to explain the nature of the present invention. It is known in the art to measure axial and lateral acceleration or related parameters, as well as axial force and rotational torque related parameters, at the earth's surface to try to determine the existence of a destructive mode in the drill string. A limitation to using surface measurements to determine destructive drill string modes is that the drill string is an imperfect communication channel for axial, lateral and/or torsional accelerations which are imparted to the drill string at or near the bottom of the wellbore. In particular, the drill string itself can absorb considerable torsion and change in length over its extended length. Moreover, much of the drill string may be in contact with the wall of the wellbore during drilling, whereby friction between the wellbore wall and the drill string attenuates some of the accelerations applied to the drill string near the bottom of the wellbore.

It is also known in the art to measure acceleration, rotation speed, pressure, weight and/or torque applied to various components of the drill string at a position located near the drill bit. Devices which make such measurements typically form part of a so-called "measurement-while-drilling" (MWD) system, which may include additional sensing devices for measuring direction of the wellbore with respect to a geographic reference and sensors for measuring properties of the earth formations penetrated by the wellbore. A limitation to using MWD systems known in the art for determining destructive operating modes in a drill string is that the data communication rate of MWD systems is generally limited to a few bits per second. The low communication rate results from the type of telemetry used, namely, low frequency electromagnetic waves, or more commonly, drilling mud flow or pressure modulation. The low communication rate requires that very selected information measured by various sensors on the MWD system be communicated to the earth's surface by the telemetry (known in the art as "in real time"). Destructive modes, however, may include accelerations having frequencies of several Hertz or more. Typically, measurements of acceleration, rotation speed, pressure, weight and/or torque are sampled at a relatively high rate, but only average amplitude, average amplitude variation or peak values are transmitted to the earth's surface without regard to whether a peak, average or average variation value corresponds to any particular drill string failure mode. As a result, MWD systems known in the art do not necessarily make the best use of the mode-related measurements made by the MWD system sensors.

It is desirable to have a method and system for identifying drill string movement modes that can communicate the identified mode to the earth's surface for analysis so as to facilitate the appropriate remedial action for each specific movement mode and reduce the chance of drill string failure.

SUMMARY OF INVENTION

One aspect of the invention is a method for determining mode of movement in a drill string. A method according to this aspect of the invention includes measuring lateral acceleration of the drill string and determining a lateral position of the drill string with respect to time from the acceleration measurements. The movement mode is determined from the position with respect to time.

Another aspect of the invention is a method for determining a mode of motion of a drill string. A method according to this aspect of the invention includes measuring a parameter related to acceleration of the drill string along at least one direction, spectrally analyzing the measurements of acceleration, and determining existence of a particular mode from the spectrally analyzed measurements.

Another aspect of the invention is a method for determining destructive torque on a bottom hole assembly. A method according to this aspect of the invention includes measuring angular acceleration from at least one location along the bottom hole assembly, and comparing the angular accelerations to a selected threshold. The selected threshold is related to moment of inertia of selected components of the bottom hole assembly and a maximum allowable torque applicable to threaded connections between the selected components. The method also includes generating a warning indication when the angular acceleration exceeds the selected threshold.

Another aspect of the invention is a method for estimating wear on a drill string. A method according to this aspect of the invention includes determining a mode of motion of the drill string; calculating side forces generated by contact between affected components of the drill string and a wall of a wellbore as a result of the mode of motion, and estimating a wear rate corresponding to the side forces and a rate of rotation of the drill string. In one embodiment, determining the mode of motion includes measuring lateral acceleration of the drill string and determining a lateral position of the drill string with respect to time from the acceleration measurements. The movement mode is determined from the position with respect to time.

Another aspect of the invention is a method for estimating hole condition. A method according to this aspect of the invention includes determining a mode of motion of the drill string, calculating side forces generated by contact between affected components of the drill string and a wall of a wellbore as a result of the mode of motion, calculating variation in torque corresponding to the modal side forces on the drill string, estimating torque variation generated at the bit, and determining the hole condition by subtracting variation in the torque variation of the bit and variation in the torque variation due to modal side forces from the total variation in torque measured at the surface. In one embodiment, determining the variation in torque from the bit is from empirical measurements of average bit torque at different rotation rates with various values of weight on bit in different formation types with similar bit condition. Determining the mode of motion includes measuring lateral acceleration of the drill string and determining a lateral position of the drill string with respect to time from the acceleration measurements. The drill string movement mode is determined from the position with respect to time.

Another aspect of the invention is a method for estimating fatigue on a drill string. A method according to this aspect of the invention includes determining a mode of motion of the drill string, calculating flexural forces generated as a result of the mode of motion, and estimating a fatigue rate from the flexural forces. In one embodiment, determining the mode of motion includes measuring lateral acceleration of the drill string and determining a lateral position of the drill string with respect to time from the acceleration measurements. The movement mode is determined from the position with respect to time.

Other aspects and advantages of the invention will be apparent from the following description and the appended claims.

DETAILED DESCRIPTION

Figure 1:
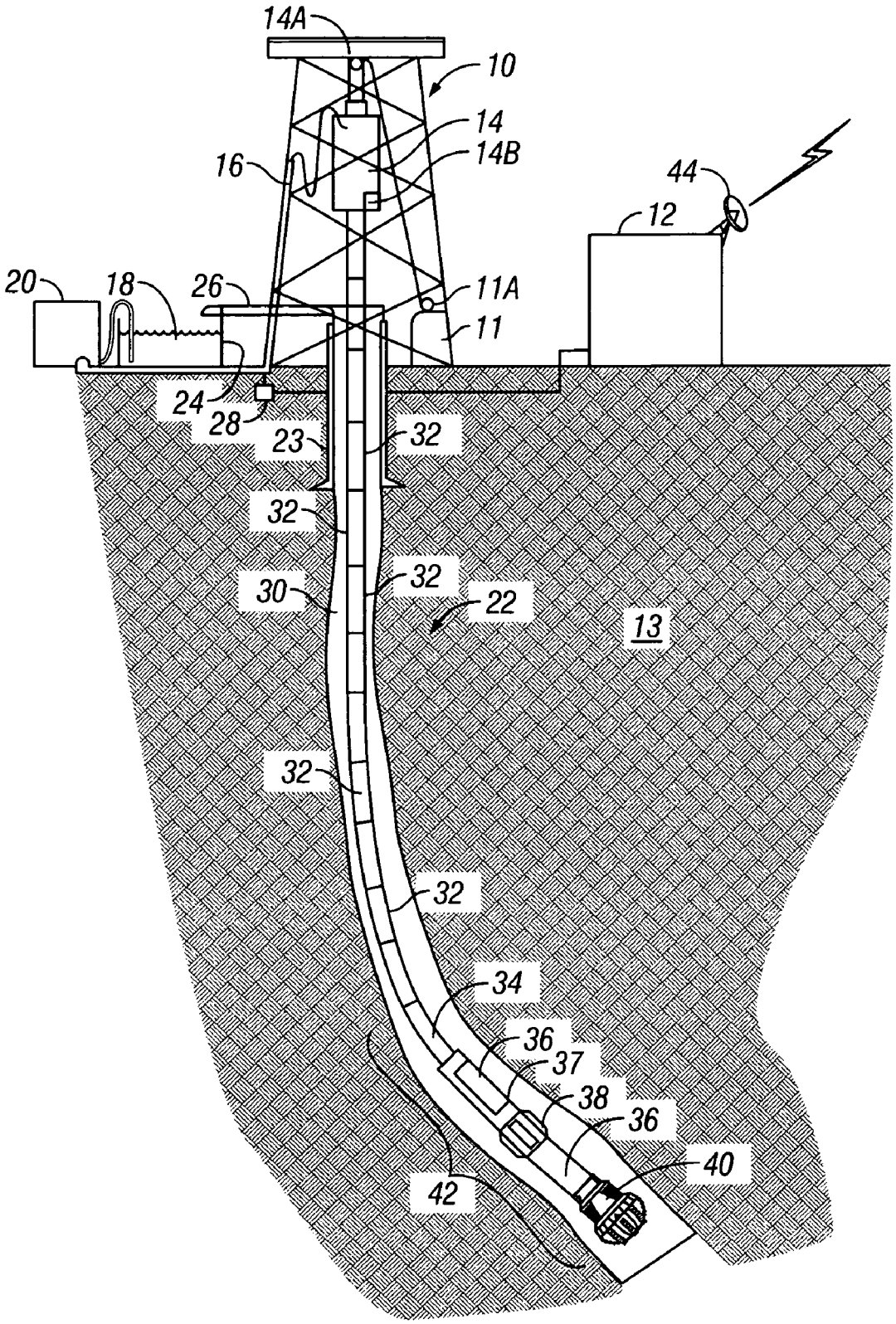
FIG. 1 shows a typical wellbore drilling operation.

FIG. 1 shows a typical wellbore drilling system which may be used with various embodiments of a method and system according to the invention. A drilling rig 10 includes a drawworks 11 or similar lifting device known in the art to raise, suspend and lower a drill string. The drill string includes a number of threadedly coupled sections of drill pipe, shown generally at 32. A lowermost part of the drill string is known as a bottom hole assembly (BHA) 42, which includes, in the embodiment of FIG. 1, a drill bit 40 to cut through earth formations 13 below the earth's surface. The BHA 42 may include various devices such as heavy weight drill pipe 34, and drill collars 36. The BHA 42 may also include one or more stabilizers 38 that include blades thereon adapted to keep the BHA 42 roughly in the center of the wellbore 22 during drilling. In various embodiments of the invention, one or more of the drill collars 36 may include a measurement while drilling (MWD) sensor and telemetry unit (collectively "MWD system"), shown generally at 37. The sensors included in and the purpose of the MWD system 37 will be further explained below with reference to FIG. 2.

The drawworks 11 is operated during active drilling so as to apply a selected axial force to the drill bit 40. Such axial force, as is known in the art, results from the weight of the drill string, a large portion of which is suspended by the drawworks 11. The unsuspended portion of the weight of the drill string is transferred to the bit 40 as axial force. The bit 40 is rotated by turning the pipe 32 using a rotary table/kelly bushing (not shown in FIG. 1) or preferably a top drive 14 (or power swivel) of any type well known in the art. While the pipe 32 (and consequently the BHA 42 and bit 40) as well is turned, a pump 20 lifts drilling fluid ("mud") 18 from a pit or tank 24 and moves it through a standpipe/hose assembly 16 to the top drive 14 so that the mud 18 is forced through the interior of the pipe segments 32 and then the BHA 42. Ultimately, the mud 18 is discharged through nozzles or water courses (not shown) in the bit 40, where it lifts drill cuttings (not shown) to the earth's surface through an annular space between the wall of the wellbore 22 and the exterior of the pipe 32 and the BHA 42. The mud 18 then flows up through a surface casing 23 to a wellhead and/or return line 26. After removing drill cuttings using screening devices (not shown in FIG. 1), the mud 18 is returned to the tank 24.

The standpipe system 16 in this embodiment includes a pressure transducer 28 which generates an electrical or other type of signal corresponding to the mud pressure in the standpipe 16. The pressure transducer 28 is operatively connected to systems (not shown separately in FIG. 1) inside a recording unit 12 for decoding, recording and interpreting signals communicated from the MWD system 37. As is known in the art, the MWD system 37 includes a device, which will be explained below with reference to FIG. 2, for modulating the pressure of the mud 18 to communicate data to the earth's surface. In some embodiments the recording unit 12 includes a remote communication device 44 such as a satellite transceiver or radio transceiver, for communicating data received from the MWD system 37 (and other sensors at the earth's surface) to a remote location. Such remote communication devices are well known in the art. The data detection and recording elements shown in FIG. 1, including the pressure transducer 28 and recording unit 12 are only examples of data receiving and recording systems which may be used with the invention, and accordingly, are not intended to limit the scope of the invention. The top drive 14 may also include sensors (shown generally as 14B) for measuring rotational speed of the drill string, the amount of axial load suspended by the top drive 14 and the torque applied to the drill string. The signals from these sensors 14B may be communicated to the recording unit 12 for processing as will be further explained.

Figure 2:
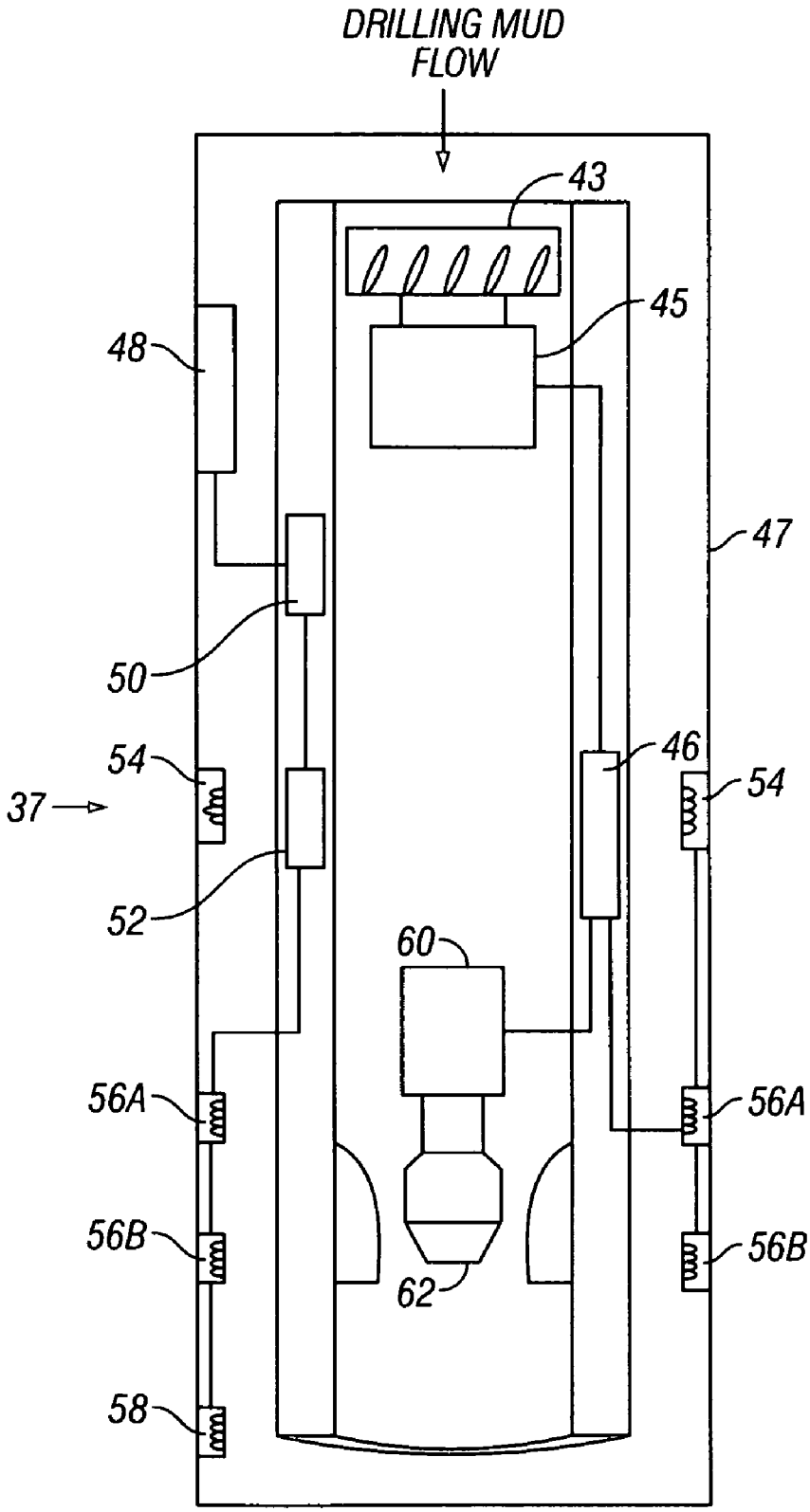
FIG. 2 shows parts of a typical MWD system.

One embodiment of an MWD system, such as shown generally at 37 in FIG. 1, is shown in more detail in FIG. 2. The MWD system 37 is typically disposed inside a non-magnetic housing 47 made from monel or the like and adapted to be coupled within the drill string at its axial ends. The housing 47 is typically configured to behave mechanically in a manner similar to other drill collars (36 in FIG. 1). The housing 47 includes disposed therein a turbine 43 which converts some of the flow of mud (18 in FIG. 1) into rotational energy to drive an alternator 45 or generator to power various electrical circuits and sensors in the MWD system 37. Other types of MWD systems may include batteries as an electrical power source.

Control over the various functions of the MWD system 37 may be performed by a central processor 46. The processor 46 may also include circuits for recording signals generated by the various sensors in the MWD system 37. In this embodiment, the MWD system 37 includes a directional sensor 50, having therein tri-axial magnetometers and accelerometers such that the orientation of the MWD system 37 with respect to magnetic north and with respect to earth's gravity can be determined. The MWD system 37 may also include a gamma-ray detector 48 and separate rotational (angular)/axial accelerometers, magnetometers or strain gauges, shown generally at 58. The MWD system 37 may also include a resistivity sensor system, including an induction signal generator/receiver 52, and transmitter antenna 54 and receiver 56A, 56B antennas. The resistivity sensor can be of any type well known in the art for measuring electrical conductivity or resistivity of the formations (13 in FIG. 1) surrounding the wellbore (22 in FIG. 1). The types of sensors in the MWD system 37 shown in FIG. 2 is not meant to be an exhaustive representation of the types of sensors used in MWD systems according to various aspects of the invention. Accordingly, the particular sensors shown in FIG. 2 are not meant to limit the scope of the invention.

The central processor 46 periodically interrogates each of the sensors in the MWD system 37 and may store the interrogated signals from each sensor in a memory or other storage device associated with the processor 46. Some of the sensor signals may be formatted for transmission to the earth's surface in a mud pressure modulation telemetry scheme. In the embodiment of FIG. 2, the mud pressure is modulated by operating an hydraulic cylinder 60 to extend a pulser valve 62 to create a restriction to the flow of mud through the housing 47. The restriction in mud flow increases the mud pressure, which is detected by the transducer (28 in FIG. 1). Operation of the cylinder 60 is typically controlled by the processor 46 such that the selected data to be communicated to the earth's surface are encoded in a series of pressure pulses detected by the transducer (28 in FIG. 1) at the surface. Many different data encoding schemes using a mud pressure modulator, such as shown in FIG. 2, are well known in the art. Accordingly, the type of telemetry encoding is not intended to limit the scope of the invention. Other mud pressure modulation techniques which may also be used with the invention include so-called "negative pulse" telemetry, wherein a valve is operated to momentarily vent some of the mud from within the MWD system to the annular space between the housing and the wellbore. Such venting momentarily decreases pressure in the standpipe (16 in FIG. 1). Other mud pressure telemetry includes a so-called "mud siren", in which a rotary valve disposed in the MWD housing 47 creates standing pressure waves in the mud, which may be modulated using such techniques as phase shift keying for detection at the earth's surface. Other electromagnetic, hard wired (electrical conductor), or optical fiber or hybrid telemetry systems may be used as alternatives to mud pulse telemetry, as will be further explained below.

In some embodiments, each component of the BHA (42 in FIG. 1) may include its own rotational, lateral or axial accelerometers, magnetometers, pressure sensors, caliper/stand-off sensors or strain gauge sensor. For example, referring back to FIG. 1, each of the drill collars 36, the stabilizer 38 and the bit 40 may include such sensors. The sensors in each BHA component may be electrically coupled, or may be coupled by a linking device such as a short-hop electromagnetic transceiver of types well known in the art, to the processor (46 in FIG. 2). The processor 46 may then periodically interrogate each of the sensors disposed in the various components of the BHA 40 to make motion mode determinations according to various embodiments of the invention.

For purposes of this invention, either strain gauges, magnetometers or accelerometers are practical examples of sensors which may be used to make measurements related to the acceleration imparted to the particular component of the BHA (42 in FIG. 1) and in the particular direction described. As is known in the art, torque, for example, is a vector product of moment of inertia and angular acceleration. A strain gauge adapted to measure torsional strain on the particular BHA component would therefore measure a quantity directly related to the angular acceleration applied to that BHA component. Accelerometers and magnetometers however, have the advantage of being easier to mount inside the various components of the BHA, because their response does not depend on accurate transmission of deformation of the BHA component to the accelerometer or magnetometer, as is required with strain gauges. However, it should be clearly understood that for purposes of defining the scope of this invention, it is only necessary that the property measured be related to the component acceleration being described. An accelerometer adapted to measure rotational (angular) acceleration would preferably be mounted such that its sensitive direction is perpendicular to the axis of the BHA component and parallel to a tangent to the outer surface of the BHA component. The directional sensor 50, if appropriately mounted inside the housing 47, may thus have one component of its three orthogonal components which is suitable to measure angular acceleration of the MWD system 37.

Figures 3, 4:
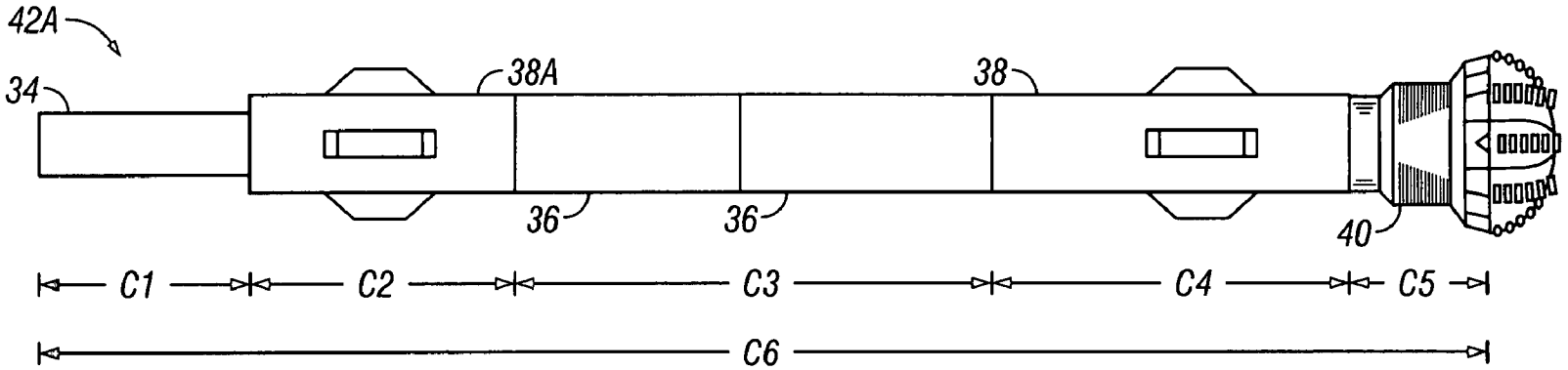
FIG. 3 shows another example of a bottom hole assembly (BHA).
FIG. 4 shows a table of component resonant frequencies for each of the BHA components shown in FIG. 3.

FIG. 3 shows another example of a BHA 42A in more detail for purposes of explaining the invention. The BHA 42A in this example includes components comprising a bit 40, which may be of any type known in the art for drilling earth formations, a near-bit or first stabilizer 38, drill collars 36, a second stabilizer 38A, which may be the same or different type than the first stabilizer 38, and heavy weight drill pipe 34. Each of these sections of the BHA 42A may be identified by its overall length as shown in FIG. 3. The bit 40 has length C5, the first stabilizer 38 has length C2, and so on as shown in FIG. 3. The entire BHA 42A has a length indicated by C6. In some embodiments of the invention, characteristic resonant and/or motion frequencies of each component of the BHA 42A may be determined by experiment and/or by modeling (e.g. finite element analysis). Characteristic frequencies of interest in embodiments of the invention are shown, for example, in the table of FIG. 4. The example characteristic frequencies include "whirl" frequencies, shown as W1–W6, axial resonant frequencies, shown as A1–A6 orsional resonant frequencies, shown as T1–T6, and a lateral (bending) resonant frequency, shown as L1–L6.

In one embodiment of the invention, the characteristic frequencies are determined for selected components of a particular BHA used in a wellbore being drilled. The example BHA shown in FIG. 1 and FIG. 3 are only two of many different BHA configurations that may be used to drill a wellbore or part of a wellbore. Accordingly, in some embodiments of the invention, the characteristic frequencies of each BHA component are typically modeled before the BHA is actually used in the wellbore using the BHA configuration to be used in the wellbore. Modeling the characteristic frequencies may include as input parameters lengths, diameters, bending stiffness, torsional stiffness, moment of inertia, mass, and material properties (e.g. density, acoustic velocity, compressibility) of each BHA component. The modeling may include expected axial force (also known as "weight on bit"), expected torque on the BHA, diameter of the bit (40 in FIG. 3), diameters of casings, fluid properties of the drilling mud (18 in FIG. 1) such as density and viscosity.

In some embodiments of the invention, the characteristic frequencies determined as a result of the modeling may be stored in the processor (46 in FIG. 2). During operation of the drill string and BHA (42 in FIGS. 2 and 42A in FIG. 3) axial acceleration is measured, lateral acceleration is measured and angular (or rotational) acceleration is measured. As previously explained, strain may be measured with respect to each motion component as an alternative to measuring acceleration. In some embodiments, axial, lateral and angular acceleration may be measured by the accelerometers in the directional sensor (50 in FIG. 2). Other embodiments may use separate accelerometers, magnetometers, or strain gauges to measure the component accelerations or strains. In still other embodiments, angular acceleration may be determined from measurements made by the magnetometers in the directional sensor (50 in FIG. 2). As is known in the art, the magnetometers measure a magnitude of the earth's magnetic field along the component direction. As the MWD system (37 in FIG. 2) rotates with the drill pipe and BHA, the direction of the earth's magnetic field with respect to the MWD system (37 in FIG. 2) also rotates. By determining the second derivative, with respect to time, of the rotational orientation of the MWD system (37 in FIG. 2) with respect to magnetic north, the angular acceleration of the MWD system (37 in FIG. 2) may be determined.

In some embodiments, the axial acceleration, lateral acceleration and angular acceleration may be measured at one position in the BHA (42 in FIG. 1). This may be at the location of the directional sensor (50 in FIG. 2) as previously explained. Characteristic vibration frequencies from each bottom hole assembly component are typically detectable at any point in the BHA with much less attenuation than described earlier when trying to detect downhole vibrations at the earth's surface. In other embodiments, the accelerations may be measured by sensors within various individual components of the BHA and signals from these sensors communicated to the processor (46 in FIG. 2) for calculation (as will be further explained) and/or communication to the earth's surface.

In some embodiments, the measurements of acceleration made by the various embodiments of sensors as described herein are processed (in processor 46 or in another computer disposed in the BHA) in a manner that will now be explained. First, the measurements of acceleration with respect to time may be spectrally analyzed. Spectral analysis may be performed, for example, by any fast Fourier transform or discrete Fourier transform method well known in the art. A result of spectral analysis is a set of values representing amplitudes of component frequencies in the acceleration data. The component frequencies can be compared to the modeled frequencies for the various BHA components to determine the presence of specific destructive modes of motion in the BHA.

Figure 5:
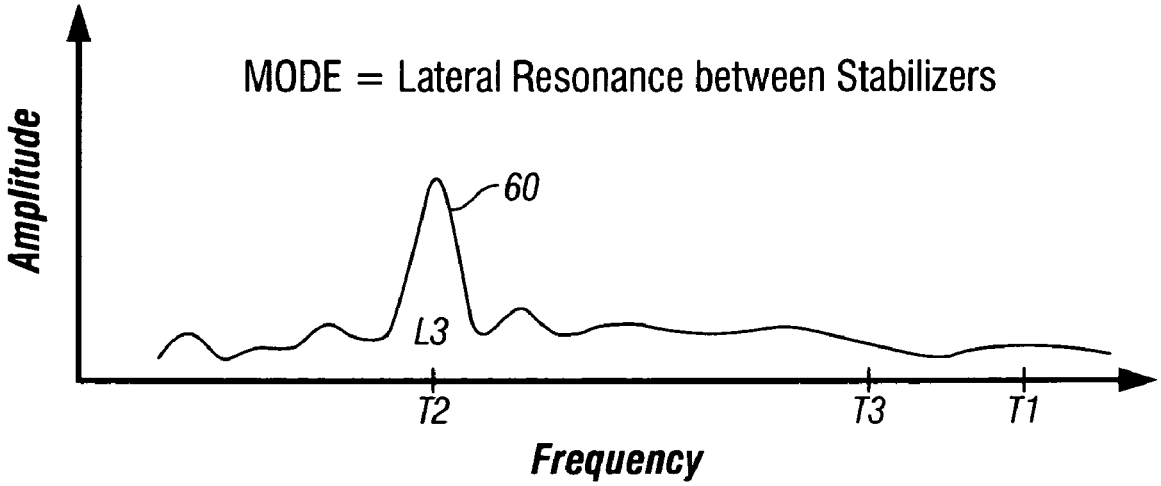
FIG. 5 shows an example of spectrally analyzed acceleration measurements which indicate existence of lateral resonance between the stabilizers shown in the example BHA of FIG. 3.

One example of a destructive mode is shown in FIG. 5, which is a graph of amplitudes of lateral acceleration component frequencies in the lateral acceleration data. An amplitude peak 60 can be observed at the expected lateral resonant frequency of the drill collars section L3. The amplitude of the lateral resonance at the peak 60 may be large enough such that the rig operator should change one or more drilling operating parameters to reduce the amplitude of the peak 60 below a predetermined threshold. The threshold may be determined by modeling or by experimentation using actual BHA components. Drilling operating parameters which may be directly controlled by the drilling rig operator include axial force on the drill bit (weight on bit), rotational speed of the top drive (14 in FIG. 4), also referred to in the art as RPM, and the rate of flow of the mud (18 in FIG. 1) by changing an operating speed of the mud pumps (20 in FIG. 1). Alleviating the resonance may also be achieved by some sequence of drilling procedures, such as the reciprocation of the drill pipe or drilling fluid reformulation.

In certain embodiments of the invention, the existence of the characteristic drilling mode frequencies having an amplitude higher than the selected threshold, such as shown at 60 in FIG. 5, is determined by calculations performed in the processor (46 in FIG. 2), as previously explained. As is known in the art, the relatively slow speed of data communication using mud pressure modulation telemetry makes it impracticable to transmit to the earth's surface in a timely manner data represented as the graph in FIG. 5. Therefore, in some embodiments, the processor may be programmed to determine the existence of a resonance above a selected amplitude threshold, such as shown at 60 in FIG. 5. If such a resonance is determined to exist, the type of resonance event is determined by comparison, in the processor (46 in FIG. 2), of the resonance frequency to prior determined resonant frequencies, and an indication of the existence of the resonance may be communicated to any one of a number of automatic downhole control systems known in the art, for example, thrusters (weight on bit control), mud flow bypass controls (to control mud motor RPM) which can then change the drilling operating parameters downhole so as to alleviate the resonance. The indication of a resonance may also be communicated to the rig operator by momentary reprogramming of the mud telemetry. The indication may take the form of a unique pressure pulse sequence, according to mud telemetry techniques well known in the art. Upon receipt of such an indication by the rig operator, a drilling procedure or any one or more of the drilling operating parameters may be changed to eliminate the destructive mode resonance.

Figure 6:
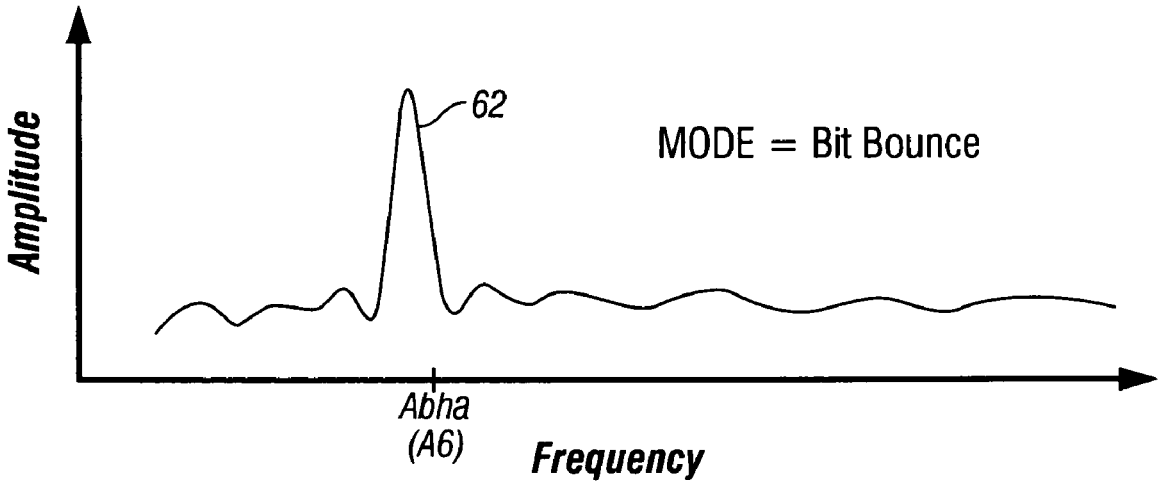
FIG. 6 shows an example of spectrally analyzed acceleration measurements which indicate existence of bit bounce for the example BHA shown in FIG. 3.
Figure 7:
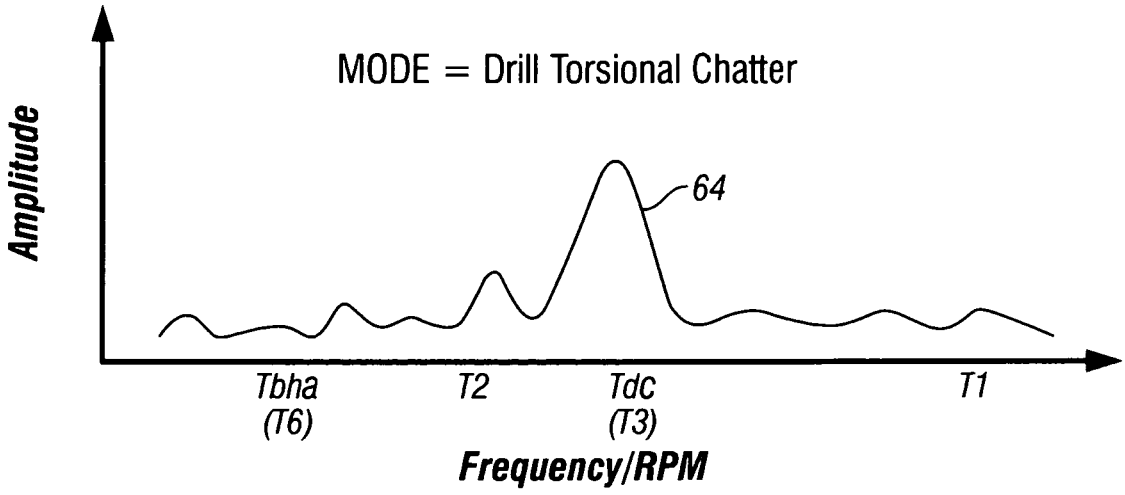
FIG. 7 shows an example of spectrally analyzed acceleration measurements which indicate torsional "chatter" in the drill collars of the example BHA shown in FIG. 3.

FIG. 6 shows another example of a destructive mode as an amplitude peak 62 occurring at the axial resonant frequency of the BHA (A6 in FIG. 4). Existence of bit bounce may be communicated to the rig operator by a different selected mud pressure pulse sequence. As in the case of lateral resonance, the bit bounce shown in FIG. 6 may be reduced in some cases by changing one or more of the drilling operating parameters. FIG. 7 shows an example of torsional "chatter" (resonance at the torsional frequency of the drill collars) as an amplitude peak at 64. Such chatter may take place, for example, as a result of rotational excitation of the BHA due to the drill bit becoming momentarily rotationally stuck in certain formations. Torsional chatter may be reduced by changing one or more of the drilling operating parameters.

Figure 8:
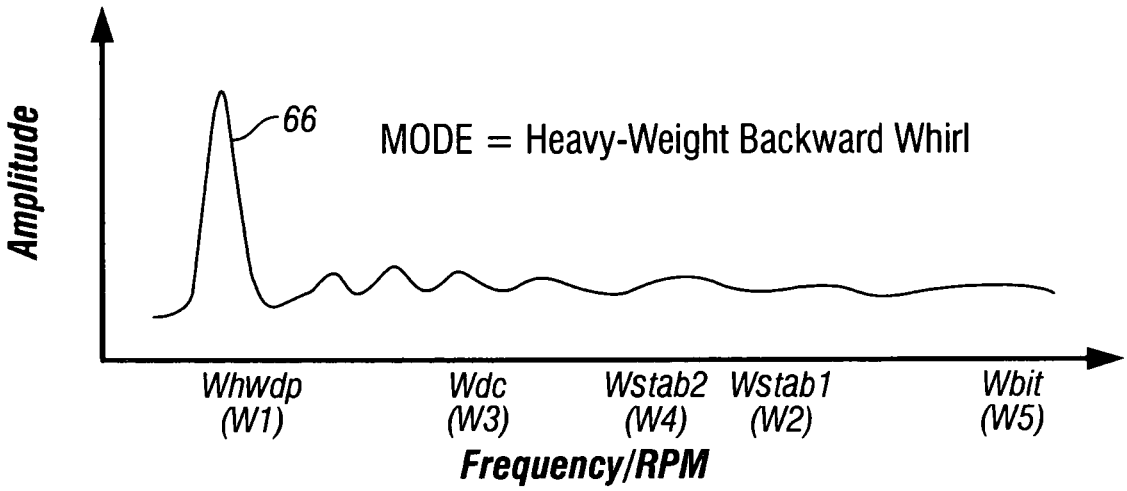
FIG. 8 shows an example of spectrally analyzed acceleration measurements which indicate existence of backward whirl in the heavyweight drill pipe of the example BHA shown in FIG. 3.

Another destructive mode shown in FIG. 8 is backward "whirl" of the heavy weight drill pipe (34 in FIG. 1). Whirl in many cases may not be reduced or eliminated merely by changing a drilling operating parameter, as is known in the art, because whirl can be a dynamically stable condition. Despite the dynamically stable nature of some whirl, it can be destructive to the affected BHA components because of the bending stresses which take place. Often, the most effective way to eliminate whirl is to stop drilling operations by stopping drill string rotation, lifting the bit off the bottom of the wellbore, and then resuming drilling using different drilling operating parameters. Note that the whirl frequency is related to component outside diameter, wellbore diameter and the rotational rate of the drill string (RPM). RPM, as may be inferred from the previous explanation of determining angular acceleration, may be determined by measuring magnetic field-based rotational position of the MWD system and calculating a first derivative thereof to determine rotational speed (RPM).

The types of destructive mode shown as resonant amplitude peaks in acceleration data in FIGS. 5–8 are not meant to be an exhaustive representation of all the modes which may be identified using methods according to the invention. To summarize this aspect of the invention, at least one acceleration component is measured at one or more locations along the BHA. The acceleration measurements are spectrally analyzed to determine existence of a component frequency corresponding to a destructive mode. If the amplitude of the destructive mode frequency exceeds a selected threshold, an indication of such condition can be communicated to automated downhole control systems or alternatively transmitted to the earth's surface for changes to drilling operating parameters. Any drill string movement mode may have more than one threshold. Each such threshold may also have an alarm code related to the severity of such drill string movement. Each such alarm code can be communicated to either the automatic downhole control system, the surface control system or to the rig operator's control console, the need either to modify one or more drilling operating parameters or alternatively to stop the drilling process.

The foregoing embodiments of a method according to the invention include performing spectral analysis and determining the existence of a destructive mode in the processor (46 in FIG. 2) or similar device disposed somewhere in the BHA (42 in FIG. 2). In other embodiments, acceleration measurements may be transmitted to the earth's surface, whereby the spectral analysis and mode determination may be performed at the earth's surface. One way to communicate the acceleration (and other) measurements to the surface for processing is to use a type of drill pipe disclosed in Published U.S. Patent Application No. 2002/0075114 A1 filed by Hall et al. The drill pipe disclosed in the Hall et al. application includes electromagnetically coupled wires in each drill pipe segment and a number of signal repeaters located at selected positions along the drill string. Alternatively fiber-optic or hybrid data telemetry systems might be used as a communication link from the downhole processor to the surface.

Figure 9:
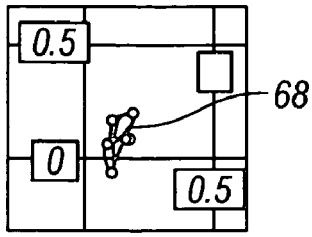
FIG. 9 shows an example of doubly integrated acceleration measurements which indicate normal rotation in a drill string.

Another embodiment for determining existence of lateral destructive modes in a BHA can be explained with reference to FIGS. 9, 10 and 11. The MWD system (37 in FIG. 2), as previously explained, includes accelerometers disposed so as to be sensitive to acceleration along three mutually orthogonal directions and magnetometers adapted to measure the rotational orientation of system, and thus the accelerometers. Typically one accelerometer direction is parallel to the housing (47 in FIG. 2) axis, and the other two directions are transverse to the housing axis. The acceleration measurements made by the transverse accelerometers can be doubly integrated to determine, with respect to time and accounting for changes in sensor orientation as measured by the magnetometers, a position of the MWD system with respect to a center of the wellbore. One example of determining lateral position with respect to time is shown in FIG. 9. A curve 68 connects points representing calculations of the position of the MWD system at selected times. The curve 68 in FIG. 9 is interpreted to indicate substantially "normal" rotation of the BHA, wherein "normal" means that the rotation is substantially about the axis of the BHA and very little lateral deflection of the BHA is taking place.

Figure 10:
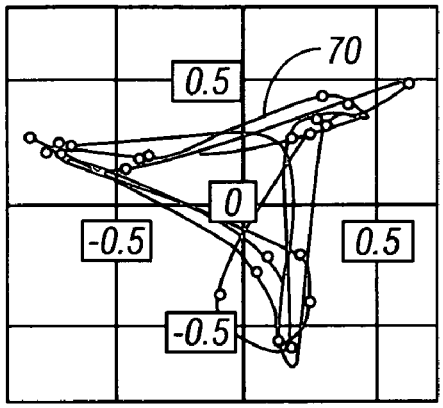
FIG. 10 shows an example of doubly integrated acceleration measurements which indicate lateral shock or bending.
Figure 11:
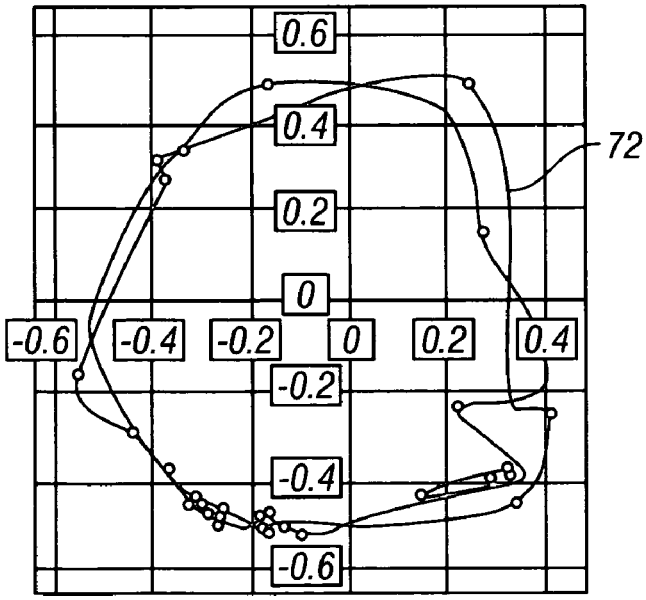
FIG. 11 shows an example of doubly integrated acceleration measurements which indicate whirl.

A corresponding lateral position curve 70 is shown in FIG. 10. The curve 70 in FIG. 10 is interpreted to indicate existence of lateral "shocks", or rapid lateral deflections of the BHA. An interesting aspect of shock type deflection as shown in FIG. 10 is that if the magnitude of lateral displacement does not result in the drill string component contacting the side of the wellbore, the shock so indicated may in some cases be essentially non-destructive or only minimally destructive to the BHA component involved. Prior art mode detection techniques, which typically cause the mud telemetry to indicate a warning when instantaneous acceleration in any direction exceeded a selected threshold, may indicate that motion such as shown in FIG. 10 required immediate intervention by the rig operator. However, other modes, such as shown at curve 72 in FIG. 11, which indicates whirl, may actually be far more destructive to the BHA or other component drill string because of the large bending stresses or drill string component wear which is believed to occur. Whirl, however, because it includes substantially continuous contact between the affected BHA or drill string component and the wall of the wellbore (22 in FIG. 1) may not produce accelerations exceeding a particular "destructive" threshold. Accordingly, prior art techniques which indicate only acceleration exceeding a selected threshold may fail to identify whirl, and at the same time, may provide false indication of destructive modes in the BHA. The embodiment described with respect to FIGS. 9, 10 and 11 requires that lateral component acceleration be measured in each component of the BHA for which the mode is to be identified, however. In one embodiment of this invention, the different drill string movement modes are identified by calculating both an average lateral displacement and a variation in lateral displacement. The normal drilling mode (shown by lateral displacement curve 68 in FIG. 9) will have a very small variation in lateral displacement and small average lateral displacement. Lateral vibration drill string movement (shown by lateral displacement curve 70 in FIG. 10) will have a larger average displacement and larger variation in lateral displacement dependent upon hole and drill string component diameters. Whirling drill string movement mode (shown by lateral displacement curve 72 in FIG. 11) will have an even larger average drill string displacement from center but typically will have a smaller variation in displacement than for lateral vibration drill string movement modes, dependent upon drill string and hole diameters. The relative direction of drill string displacements can be used to discriminate between forward and backward whirling modes.

Figure 12:
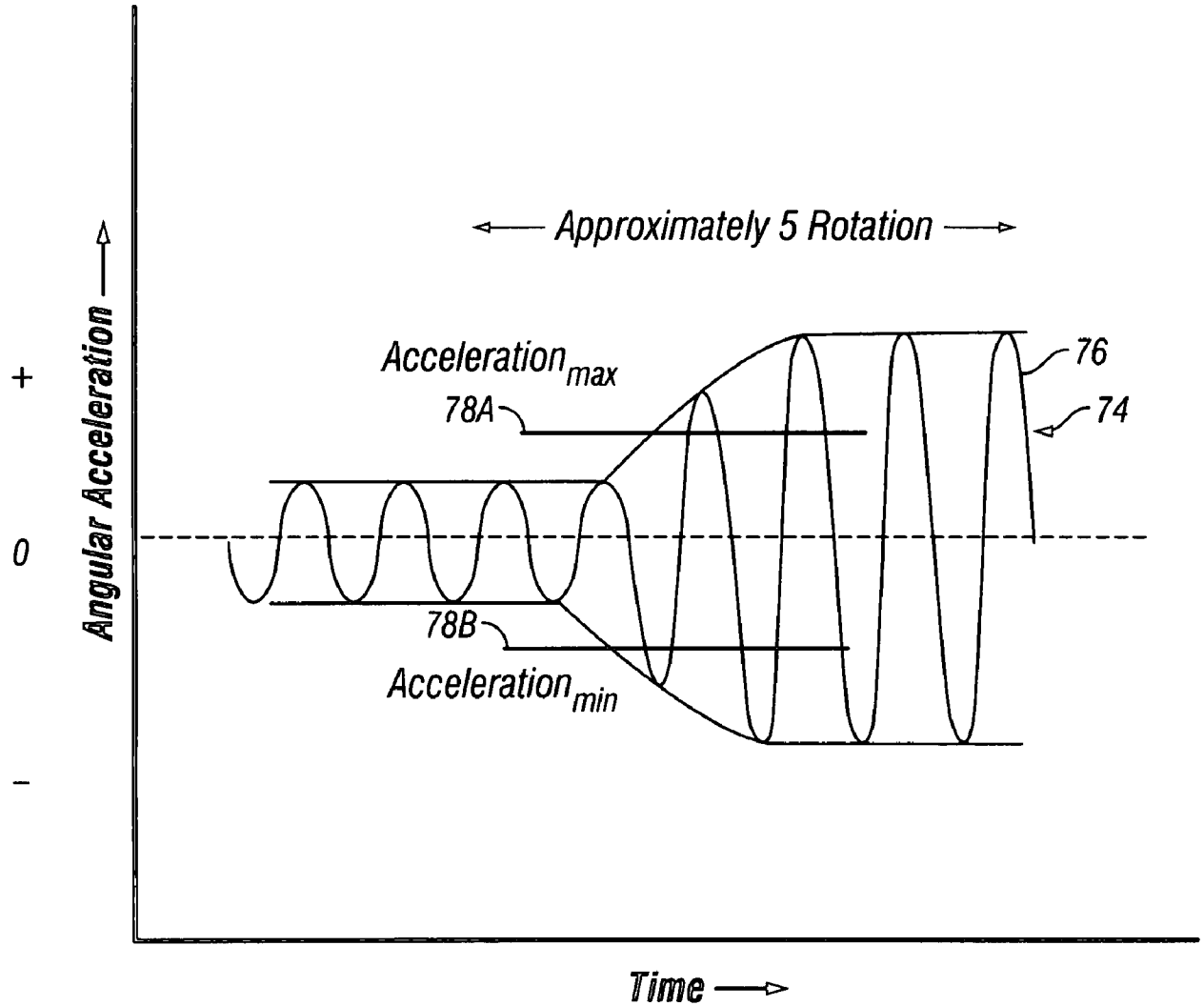
FIG. 12 shows a graph of instantaneous, maximum and minimum angular accelerations on the BHA with respect to time.

Still another embodiment of the invention may be better understood by referring to FIG. 12. In this embodiment, at least one sensor disposed in the BHA, or in the MWD system (37 in FIG. 2) measures a parameter related to angular acceleration. A graph of such measurements made with respect to time and as recorded in the processor (46 in FIG. 2) is shown at curve 74 in FIG. 12. In the ideal situation, the BHA would rotate at substantially constant speed during drilling operations, and the angular acceleration would be substantially zero except when rotation of the BHA is started or stopped. However, the rotation speed of the BHA is affected by the interaction between the drill bit (40 in FIG. 2) and drill string with the formations (13 in FIG. 1), and frictional forces between the various components of the BHA and the wall of the wellbore (22 in FIG. 1). In some cases, the drill string is known to stop rotating completely, becoming rotationally "stuck" for some time intervals in some conditions of excessive bit torque and/or poor hole cleaning. The drill string may remain rotationally stuck until the torque applied to the drill string from surface exceeds a breakdown value, whereupon the drill string resumes rotation. However, during the time the bit (or lower portion of the BHA) is not rotating, the drill string above the BHA up to the surface (up to top drive 14 in FIG. 1) is still rotating. As is known in the art, the drill string above the BHA, up to the earth's surface, may absorb a substantial amount of rotation from the surface, sometimes as many as three or more full rotations of the pipe, before enough torque is applied to the stuck part of the drill string to cause the stuck part of the drill string to resume rotation. The torque stored in the drill string above the stuck part may release with considerable rotational acceleration when the stuck part of the drill string is finally freed to rotate. Such unwinding, when applied to the BHA, exerts considerable torque on the BHA components. Conversely, a large torque is applied as a result of continued upper drill string rotation to that portion of the drill string which becomes stuck. In some cases, either from sticking or unwinding, an amount of torque which can shear, yield or loosen threaded connections between the components of the BHA and drill string may result from the magnitude of the angular acceleration applied during such "wind up" and release rotation of the BHA and drill string. Therefore, in the embodiment illustrated in FIG. 12, an angular acceleration is measured, typically but not necessarily exclusively by the MWD system. Threshold maximum torques (in both directions of rotation), which are related to a shear failure value or a release (connection "break out") value of the threaded connections is determined for each threaded connection in the BHA. Failure values of torque for any or all of the tubular components of the drill string may also be determined. The threshold torques, shown at 78A and 78B, may be determined, in some embodiments, by treating multiple drill string components either side of a threaded connection as a single mass, and assuming angular acceleration is substantially equal along the length of those drill string components. In some embodiments, a threshold torque may be related to a failure torque of one or more tubular components of the drill string.

A moment of inertia of each drill string and BHA component is known or can be readily determined. A torque applied between each BHA component can be determined from the component inertia values and from the measured angular acceleration. The thresholds can be set to operationally significant percentages of the lowest torque which would cause breaking of a threaded connection or loosening of a threaded connection in the BHA based upon such inputs as drill string component material, connection type, thread lubricant friction factor and applied make-up torque. If the angular acceleration measured exceeds either threshold 78A, 78B, such as shown at 76 in FIG. 12, an indication of such condition may be transmitted to the earth's surface as previously explained with respect to FIGS. 5–8. Upon receipt of such indication, the rig operator may change one or more drilling operating parameters, or instigate operational procedures such as reciprocation of the drill string or adjusting of drilling fluid formulation in order to reduce or eliminate the excessive angular acceleration. As was also previously explained, the calculation of whether the angular acceleration exceeds the selected threshold may also be performed at the earth's surface, particularly when using a "wired" drill pipe such as disclosed in the Hall et al. application described above, or any other form of high speed telemetry.

In some embodiments, axial acceleration is measured at the BHA (42 in FIG. 1). Axial acceleration may be measured using the accelerometer shown at 58 in FIG. 2, for example. In the processor (46 in FIG. 2) a maximum value of axial acceleration is determined in a selected time interval. A suitable time interval may be on the order of 5 to 20 seconds. The time interval is ultimately related to the time period of the previously described stick-slip motion of the drill string. The maximum axial acceleration is used to calculate a maximum axial force on the components of the BHA by using the mass of the individual components of the BHA and the acceleration determined as just explained. The axial force is combined with the maximum torque determined as previously explained with respect to FIG. 12, to determine whether a safe combined operating limit for the various components of the BHA is being exceeded. Methods for combining maximum torque with maximum axial force to determine whether a BHA is operating within safety limits are well known in the art.

One embodiment of the invention includes estimating downhole rotational accelerations from variations in the torque applied to the drill string by the top drive (14 in FIG. 1). In this embodiment, as shown in the flow chart of FIG. 14, torque is measured at the surface. Next, the amplitude of the torque variations and average surface torque values are determined. It is assumed that the variations in torque measured at the surface are related to variations in torque along the drill string and at the BHA. The torque variations thus estimated or determined at the BHA and along the drill string are then converted to angular accelerations, or used as torque values directly assuming the torque variation is generated at various points along the drill string, as explained above with reference to FIG. 12, to determine if a safe torque on components of the BHA is being exceeded. Calculating whether a safe torque is being exceeded may include assuming torque is being applied at selected points along the BHA, and calculating torque from inertia of the BHA components disposed above and below each selected point.

Another embodiment, which is described with reference to FIG. 15, includes measurement of RPM (rotational speed) using measurements from the magnetometers or accelerometers in the MWD system (37 in FIG. 1). Maximum and minimum values of RPM may be determined by the processor (46 in FIG. 2). At the surface, after communicating maximum and minimum RPM to the surface such as by mud telemetry, a periodicity of the RPM is estimated by determining a periodicity of variations in torque measured at the surface. A periodic waveform is then fitted to the RPM values communicated to the surface. The periodic waveform will have an amplitude that corresponds to the difference between the maximum and minimum RPM, and a periodicity that corresponds to the periodicity of the torque variations. Then, maximum and minimum angular accelerations may be estimated from the periodic waveform. The values of angular acceleration may be used as in the embodiment described above with respect to FIGS. 12 and 13 to determine whether a safe torque is being exceeded in any of the components of the drill string or BHA. Alternatively, the RPM values measured by the MWD system (37 in FIG. 1) may be conducted to the processor (46 in FIG. 2) and fitted to a periodic waveform in the processor (46 in FIG. 2). Angular accelerations may then be determined from the periodic waveform.

Figure 13:
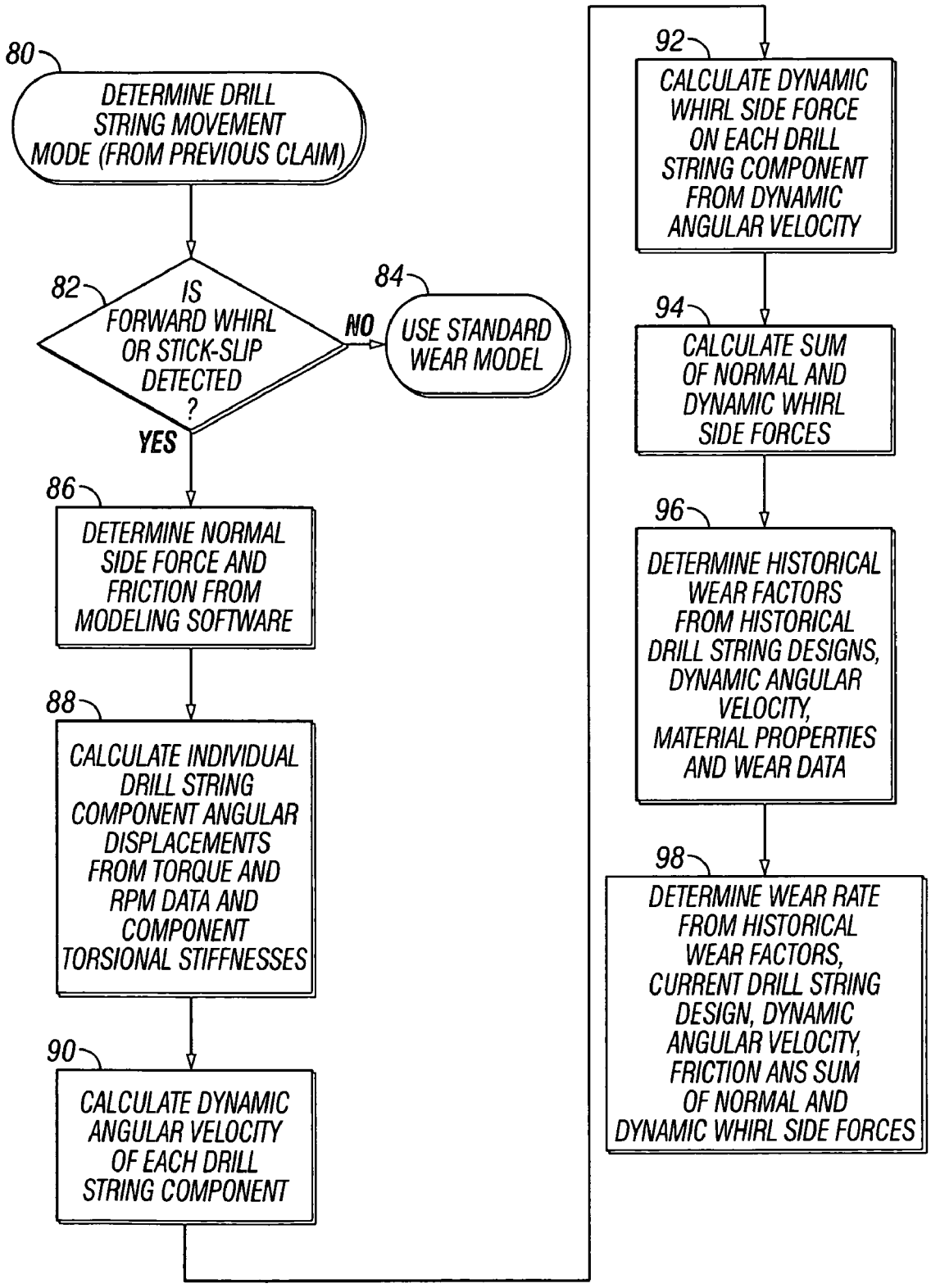
FIG. 13 is a flow chart of an embodiment of a method for determining wear rate on components of a drill string from a mode of drill string motion.

Another aspect of the invention is the determination of drill string component wear rate by combining the determination of drill string movement mode with calculated side forces, rotation rate and well bore and component material properties. Referring to FIG. 13, first at 80, the mode of motion of the drill string may be determined as previously explained with respect to FIGS. 9 10 and 11. If the mode of motion is determined to be stick slip or whirl, at 82, the process continues. If the mode is normal, at 84, models known in the art may be used to estimate wear. Next, at 86. expected side forces on the various components of the drill string are determined, for example, using any one of a number of "torque and drag" simulation programs known in the art. One such torque and drag simulation computer program or "model" is sold under the trade name WELLPLAN by Landmark Graphics Corp., Houston, Tex. Such models predict, for example, a necessary hookload and surface torque, using as inputs, among others, the drill string configuration, expected wellbore trajectory and the formations expected to be drilled in the form of friction factors. Such models output, at any selected position along the drill string, a lateral force and internal stresses on the components of the drill string. In situations where the drill string rotates without destructive mode of motion ("normal rotation") the side forces, combined with wear rates calculable from the material properties of the components of the drill string, the earth formations, and the composition of the drilling mud can provide a reasonable estimate of the rate of wear of the various components of the drill string as a result of the rubbing motion of the various components of the drill string on the wall of the wellbore. This is shown at 86 in FIG. 13. Alternatively, friction factors, normal rotation axial forces and normal rotation drill string side forces (including buckling side forces) can be determined using as inputs for the torque and drag modeling actual parameters such as free rotating, up- and down-weights (hookloads of the drill string while raising and lowering the drill string) together with actual weight on bit, torque, RPM, drill string component lengths, diameters, stiffness and other descriptions, wellbore trajectory and diameters, and drilling fluid properties such as density.

As will be appreciated from the previous description of destructive modes of motion, in particular stick-slip and forward whirl (wherein a precession of the drill string axis is in the same direction as the rotation of the drill string), side forces and the rates of rotation may change rapidly in such destructive modes. For example, in stick-slip motion where forward whirl is occurring, the rotational speed of the drill string may vary from zero to several times the nominal rate or average rate of rotation of the drill string. Side force on the drill string resulting from forward whirl is related to the square of the rotational speed of the drill string. Therefore, a total side force on the drill string is related to the sum of the side force from normal rotation plus the forward whirl induced force.

In an embodiment of a method according to this aspect of the invention, a next step is to estimate rotational speed of the drill string at selected positions along the drill string. How to make such estimates can be explained as follows. The surface rotation rate of the top drive (14 in FIG. 1) or other surface drive on the drill string, and the average rpm over the entire drill string must be substantially identical even over a relatively short time interval (typically on the order of 5 to 10 seconds). Rotational speed within one or more components of the BHA may be measured by using magnetometer measurements or angular acceleration measurements as previously explained with respect to FIGS. 5 through 10. In one embodiment, the rotational speed of the drill string at any position along the drill string can be determined by a linear interpolation of rotational speed from the measured speed at the BHA to the measured speed at the surface. This is shown at 90 in FIG. 13.

In another embodiment, variation of the rotational speed at any position along the length of the drill string can be estimated by linear interpolation along each drill string section of equal torsional stiffness. To account for different torsional stiffnesses of individual drill string components, it is first necessary to calculate angular position at the BHA with respect to time, and angular position at the surface with respect to time. Change in angular position is converted to torque. The torque is converted to an equivalent angular displacement using as a scaling factor the torsional stiffness and length of each drill string component. The angular displacement or orientation at each position may then be converted to a rotational speed at each position, typically by differentiation with respect to time.

Discontinuities in rotational speed (in cases where the drill string momentarily stops rotation at at least one location) can be modeled as torsional force increasing linearly with respect to time and increasing linearly over the length of the drill string from the earth's surface down to the stuck drill string location. While the stuck portion remains rotationally fixed, the torque applied to each section of the drill string is converted to an equivalent angular displacement using as a scaling factor the torsional stiffness and length of each drill string component. The angular displacement at each position may then be converted to a rotational speed at each position. When the stuck portion of the drill string releases, stored torque above the stuck portion is applied to the previously stuck portion of the drill string. In an embodiment which accounts for stick slip motion, a position at which the drill string is stuck must be selected. Rotational displacement or position with respect to time can then be interpolated, taking into account the torsional stiffness of each drill string component from the stuck position to the earth's surface, just as in the previous embodiment. This is shown at 88 in FIG. 13.

Figure 14:
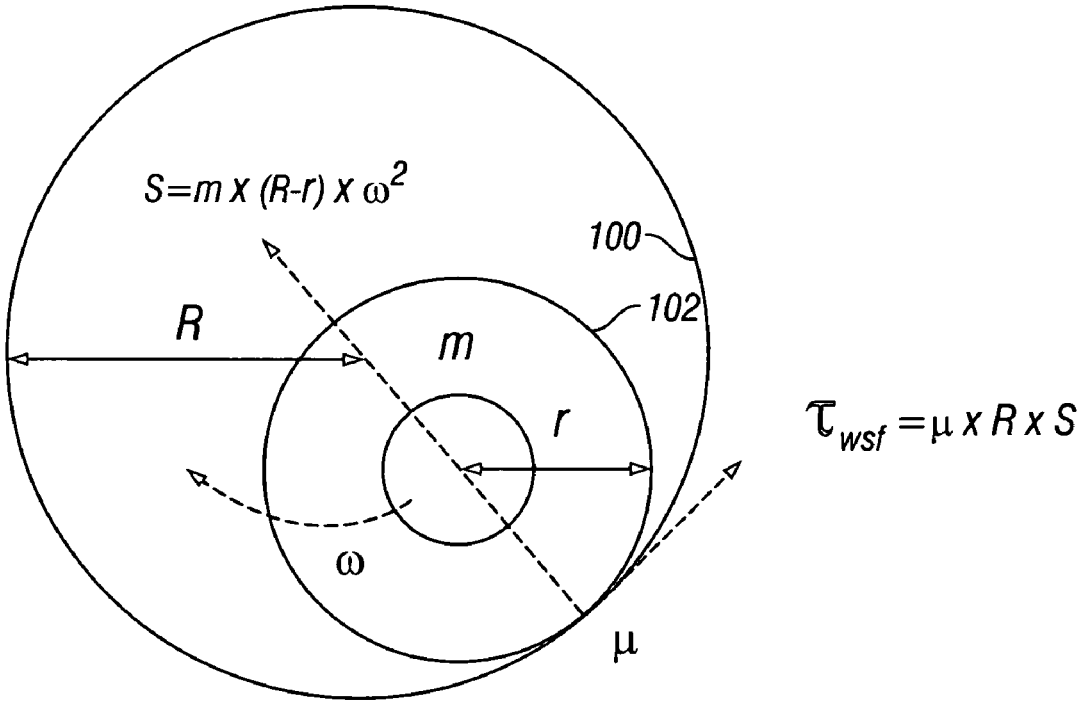
FIG. 14 shows the centripetal side force and frictional torsional force resulting from forward whirling mode of motion of the drill string.

As is known in the art, forward whirl velocity is substantially equal to the rotation rate of the drill string. The side force attributable to the forward whirl is then calculated based upon the rotation rate of the drill string (RPM) at each position along the drill string, mass of each of the drill string components and whirl radius (the wellbore radius less the drill string component radius). As shown in FIG. 14, the frictional torque per unit length $\tau_{wsf}$ can be calculated as follows.

$$S=m\times(R-r)\times\omega^2$$

in which S represents the centripetal force acting on the drill string component, m represents the mass of the component, r represents the component radius and R represents the wellbore radius. ω represents the whirl velocity. From the above expression, the torque can be calculated by the expression:

$$\tau_{wsf}=\mu RS$$

In the preceding expression, μ represents a coefficient of friction between the wellbore wall (100 in FIG. 14) and the outer surface of the BHA components (102 in FIG. 14).

Next, based upon such inputs as axial loading at each position along the drill string (which is determinable using a torque and drag model), bending stiffness of each drill string component, drill string component dimensions and the previously determined whirl velocities, a contact length along a drill string component (that may be variable if some components have tool joint upsets) is calculated. Contact length is a length of rubbing contact between the drill string component and the wellbore wall. The vector sum of the normal rotation drill string side force and the calculated whirl dynamic centripetal force is then distributed over the contact length for computing such parameters as total dynamic side force along the affected drill string components. This is shown generally at 94 in FIG. 13.

The next step in the method includes calculating wear rate using the RPM, total dynamic side force, contact length, wellbore friction factors (from the torque and drag model) and wear factors. Wear factors may be estimated, at 96 in FIG. 13, from empirical data derived from historical wear data and such related parameters as drill string component material properties, hard-banding type and hard-banding thickness of any applied hardfacing materials, estimated dynamic side forces, wellbore friction factors and duration of rotation. Calculating the wear rate for the drill string under observation is shown at 98 in FIG. 13.

Another aspect of the invention is a method for determining the fatigue rate of drill string components. One embodiment of the invention includes adding bending fatigue rates attributable to particular modes of motion of the drill string to fatigue rates computed from the bending, around wellbore trajectory changes, of normally rotating drill string components. The bending fatigue from normal rotation may be calculated using the previously described torque and drag models such as the WELLPLAN model.

Figure 15:
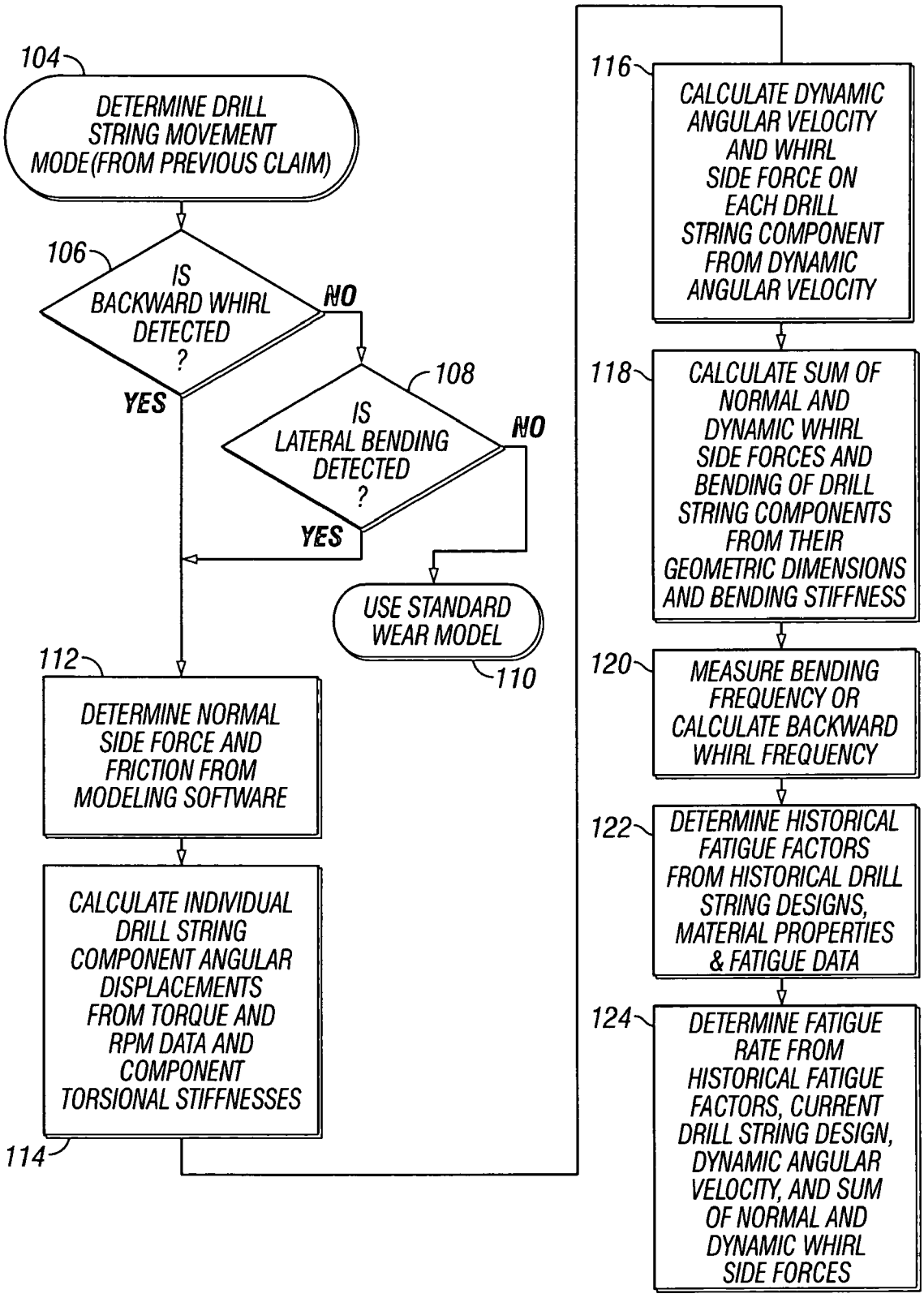
FIG. 15 is a flow chart of an embodiment of a method for determining fatigue rate on components of a drill string from a mode of drill string motion.

The first step in determining bending fatigue rate, and referring to FIG. 15, is determining the drill string movement mode, at 104, including the detection of "backward whirl", at 106, "lateral bending", at 108, and "stick-slip" RPM variation at any location in the drill string. Determining mode of motion of the drill string and the RPM at any point along the drill string may be performed using embodiments such as previously explained herein. A speed of backward whirl, if detected, may be calculated by methods known in the art. Existence of lateral bending may also be detected as previously explained. If no destructive mode of motion is detected, at 110, a conventional wear model known in the art may be used to estimate wear and/or fatigue.

Axial forces and side forces (including buckling side forces) at each position along the drill string can be determined using a torque and drag model such as the WELLPLAN model. Inputs to the torque and drag model may include either estimates or actual parameters such as actual free rotating, up- and down-weights together with applied weight on bit, torque, RPM, drill string component lengths, diameters, stiffness and other descriptions, wellbore trajectory and diameters, and fluid properties such as density.

When backward whirl is detected, whirl velocity is then calculated using the diameter of the affected drill string component, the wellbore diameter and RPM applied at the surface. The rate of whirl bending is directly related to the whirl velocity and the RPM. The centripetal whirling side force attributable to the whirling is calculated from the mass of the affected component and the whirl speed. A bending amplitude for affected components of the drill string can be calculated from the whirl side force, normal side force, the lateral bending stiffness of the affected components and the diameter of the affected components and proximate drill string components, at 118 in FIG. 15. The fatigue rate is then calculated for each laterally bending component using the calculated bending rates, RPM, bending amplitudes, and fatigue factors estimated from empirical data derived from tracking historical fatigue measurements and such related parameters as drill string component material properties, estimated dynamic bending rates and duration of rotation.

In another embodiment, a fatigue rate attributable to lateral bending is calculated. The frequency at which lateral bending takes place is related to its frequency, and lateral bending amplitude for each drill string component can be estimated from the dimensions of the affected drill string components and the wellbore diameter. As previously explained, existence of lateral bending and the drill string component in which lateral bending is taking place may be determined by spectral analysis of acceleration data, for example. The fatigue rate is then calculated for each laterally bending component using the measured bending rates, estimated bending amplitudes, and fatigue factors estimated from empirical data derived from tracking historical fatigue measurements and such related parameters as drill string component material properties, historically measured dynamic bending rates, drill string component and wellbore dimensions, and duration of bending.

As explained above with respect to FIGS. 13 and 14, frictional forces on various components of the drill string, due to rotational movement of the drill string against the wall of the wellbore, can be estimated from the mode of motion of the drill string, the mass of the drill string components, and the rotation rate of the drill string. In one embodiment, the calculated frictional forces can be used to estimate an amount of torque which may be attributable to the condition of the wellbore. In one embodiment, this amount of torque is estimated as an excess of an amount of torque needed to rotate the drill string from the surface (such as by top drive 14 in FIG. 1) over the estimated drill string frictional forces and amount of torque needed to turn the drill bit (40 in FIG. 1).

Figure 16:
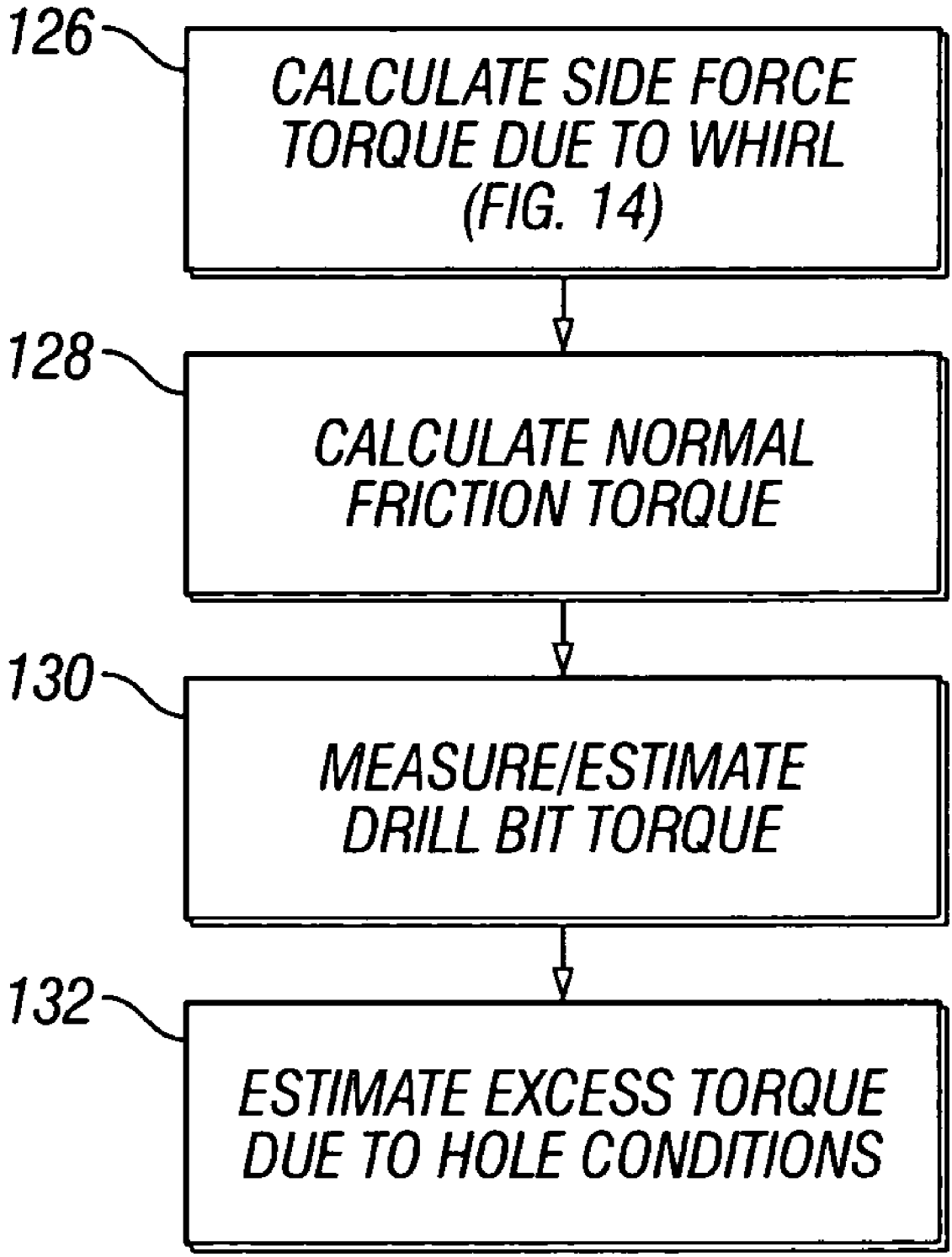
FIG. 16 is a flow chart of an example method of comparing surface measured torque with respect to expected surface torque to determine unsafe conditions in the wellbore.

Referring to FIG. 16, at 126, the amount of torque exerted as rotating friction due to side forces on the drill string are determined as previously explained above with respect to FIGS. 13 and 14. Note that if the mode of motion determined (see, e.g., 84 in FIG. 13) does not include forward whirl or rotational stick-slip, the amount of side force torque determined at 126 will be substantially equal to zero.

At 128, the so-called "normal" torque needed to turn the drill string is estimated. In one embodiment, normal side forces on the various components of the drill string can be estimated using a torque and drag model known in the art, such as the model previously noted sold under the trade name WELLPLAN. Using the rotary speed of the drill string, normal forces estimated from the model, and coefficients of friction of the earth formations (13 in FIG. 1) and the components of the drill string, a good estimate of the amount of torque needed to turn the drill string from the earth's surface can be made.

At 130 in FIG. 16, an amount of torque needed to turn the drill bit (40 in FIG. 1) is estimated or measured. Measuring torque needed to turn the drill bit can be performed by various torque sensors known in the art which are included in the BHA (42 in FIG. 1). One such sensor is sold under the trade name COPILOT by Baker Hughes, Inc., Houston, Tex. Alternatively, the torque used to turn the bit can be estimated by, for example, historical data on similar earth formations to the one being drilled, and for drill bits the same as or similar to the bit being used. Other data used to estimate bit torque may include rotary speed of the bit and amount of axial force (weight) applied to the bit. As is known in the art, the axial force on the bit can be determined by a sensor in the BHA such as the previously referred to COPILOT sensor, or may be estimated from the surface measurements (such as by sensor 14B in FIG. 1).

At 132 in FIG. 16, the values of torque measured and/or estimated as explained above at 126, 128 and 130 are added and are compared to the amount of torque actually exerted by the top drive (14 in FIG. 1). As explained above with respect to FIG. 1, the torque can be measured by a suitable sensor, such as shown at 14B. If the condition of the wellbore is such that nothing in the wellbore causes any additional friction, the sum of the measured/estimated torques should substantially equal the torque exerted by the top drive (14 in FIG. 1). In this embodiment, an amount of torque exerted by the top drive which exceeds the sum of the measured/estimated torques by a selected threshold amount can be used as an indication of unsuitable or even dangerous conditions in the wellbore. In some embodiments, the recording unit (12 in FIG. 1) may be programmed to send an alarm or other warning indicator to the drilling rig operator if the threshold is exceeded.

Various embodiments of the invention provide a method and system for identifying destructive modes of motion and excessive wear and/or fatigue rates of a drill string, such that a drilling rig operator may take corrective measures before a drill string component fails.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A method for determining destructive torque on a bottom hole assembly, comprising:

measuring a parameter related to angular acceleration at at least one location along the drill string;

comparing angular acceleration determined from the measured parameter to a selected threshold, the selected threshold related to a moment of inertia of selected components of the drill string and a maximum torque applicable to at least one of threaded connections between the selected components, and tubular components of a drill string; and generating a warning indication when the angular acceleration exceeds the selected threshold.

2. The method as defined in claim 1 wherein the generating a warning indication comprises reformatting a mud pressure modulation telemetry scheme.

3. The method as defined in claim 1 wherein the selected components comprise at least one of a bit, a mud motor, an MWD tool, a joint of drill pipe, a stabilizer and a drill collar.

4. The method as defined in claim 1 further comprising changing at least one drilling operating parameter in response to the generating the warning indication.

5. The method as defined in claim 4 wherein the at least one drilling operating parameter comprises at least one of weight on bit, rotary speed of the drill string and flow rate of a drilling fluid.

6. The method as defined in claim 1 wherein the parameter comprises angular acceleration.

7. The method as defined in claim 1 wherein the parameter comprises torque measured in at least one component of the bottom hole assembly.

8. the method as defined in claim 7 furthur comprising determining a periodicity of the torque, measuring a rotational speed variation of the bottom hole assembly, and determining angular acceleration from a waveform having amplitude corresponding to the variation of rotational speed and periodicity corresponding to the periodicity of the torque.

9. The method as defined in claim 1 wherein the parameter comprises rotational speed at the bottom of the hole assembly.

10. The method as defined in claim 9 furthur comprising determining angular acceleration from the rotational speed of the bottom hole assembly.

11. The method as defined in claim 10 wherein the determining angular acceleration comprises fitting a periodic waveform to the rotational speed of the bottom hole assembly, and determining the angular acceleration from the periodoc waveform.

12. The method as defined in claim 1 wherein the parameter comprises torque applied to a drill string at the earth's surface.

13. The method as defined in claim 1 furthur comprising:

measuring a parameter related to axial acceleration of the bottom hole assembly;

determining axial forces from the measured parameter;

combining the determined axial forces with a torque determined from the parameter related to angular acceleration; and generating a warning signal when combined torque and axial force exceeds a combined safe operating threshold.

14. An apparatus for determining destructive torque on a bottom hole assembly, comprising:

a sensor measuring angular accelaration at at least one location along the drill string;

means for comparing angular acceleration to a selected threshold operatively coupled to the sensor, the selected threshold related to a moment of inertia of a selected components of the bottom hole assembly and a maximum torque applicable to threaded connections between the selected components; and means for generating a warning indication when the angular acceleration exceeds the selected threshold.

15. The apparatus as defined in claim 14 wherein the means for generating a warning indication comprises means for reformatting a mud pressure modulation telemetry scheme.

16. The apparatus as defined in claim 14 wherein the selected components comprise at least one of a bit, a joint of drill pipe, a mud motor, an MWD tool, a stabilizer and a drill collar.

17. A method for determining an excessive torque condition in a wellbore, comprising:

measuring a parameter related to torque on components of a drill string in the wellbore;

determining a torque exerted by a drill bit coupled to a lower end of the bottom hole assembly;

determining a torque needed to rotate a drill string coupled above the bottom hole assembly;

determining a difference between a sum of the drill bit torque and the required drill string torque, and a determined from the measured parameter require to rotate the drill string from the earth's surface; and indicating the excessive torque condition when the difference exceeds a selected threshold.

* * * * *